US005388708A

United States Patent [19]

Bouchillon et al.

[11] Patent Number: 5,388,708

[45] Date of Patent: Feb. 14, 1995

[54] MULTIPLE HYDROCYCLONE ASSEMBLY

[75] Inventors: Charles W. Bouchillon, Starkville, Miss.; Andrew Franko, Spring Valley, Ohio

[73] Assignee: Fluid Quip, Inc., Springfield, Ohio

[21] Appl. No.: 137,431

[22] Filed: Oct. 15, 1993

[51] Int. Cl.[6] ..... B04C 7/00

[52] U.S. Cl. ..... 209/728; 209/734

[58] Field of Search ..... 209/728, 729, 732–734, 209/727

[56] References Cited

U.S. PATENT DOCUMENTS

| | | | |
|---|---|---|---|
| 3,261,467 | 7/1966 | Wikdahl | 209/728 |
| 3,486,618 | 12/1969 | Wikdahl . | |
| 3,598,731 | 8/1971 | Frykhult et al. . | |
| 3,959,123 | 5/1976 | Wikdahl | 209/728 |
| 4,260,480 | 4/1981 | Lewis et al. . | |
| 4,539,105 | 9/1985 | Metcalf | 209/728 X |

*Primary Examiner*—David H. Bollinger

*Attorney, Agent, or Firm*—Jacox & Meckstroth

[57] ABSTRACT

A multiple hydrocyclone assembly includes a closed tubular vertical housing enclosing two concentric vertical cylinders which cooperate with the housing to define an inner cylindrical outlet chamber and concentric annular inlet and outer outlet chambers. Multiple hydrocyclones or cyclonettes are mounted in axially extending vertical rows and in corresponding radial positions in the cylinders from the outer surface of the outer cylinder, and the housing and concentric cylinders are formed in sections which are coupled together in end to end relation. Individual cyclonettes can be removed and replaced after removal of one or more of the housing sections. In order to increase the pressure of the feed stock to be cleaned which is supplied to the cyclonettes in the upper portion or sections of the assembly, vertically extending flow channels are provided in the lower portion of the inlet chamber by omitting cyclonettes from the rows in the lower sections of the assembly.

14 Claims, 2 Drawing Sheets

MULTIPLE HYDROCYCLONE ASSEMBLY

BACKGROUND OF THE INVENTION

The present invention relates to multiple hydrocyclone assemblies of the canister type for cleaning or otherwise separating a suspension in a liquid carrier and wherein multiple individual hydrocyclones, generally referred to as cyclonettes, are assembled in a radial pattern in a closed tubular housing and share common inlet and outlet conduits. Typical examples of this general type of hydrocyclone assemblies are disclosed in Wikdahl U.S. Pat. No. 3,486,618, Frykhult et al U.S. Pat. No. 3,578,731 and Lewis et al U.S. Pat. No. 4,260,480.

SUMMARY OF THE INVENTION

The present invention is directed to an improved multiple hydrocyclone assembly which is of simple and compact construction and provides for substantially uniform separation of the suspension throughout the assembly. The multiple hydrocyclone assembly of the invention preferably comprises a vertical tubular housing enclosing concentric stainless steel cylinders which cooperate with the housing to define two concentric annular chambers surrounding a central cylindrical chamber. Multiple hydrocyclones or cyclonettes are positioned in vertical rows and extend radially through the inner and outer cylinders with the inlet of each cyclonette in the intermediate annular inlet chamber. The outlet ports at the apex and base of the cyclonettes open into the central and outermost chambers, respectively.

The housing is preferably made in vertical sections so that if any cyclonettes need to be replaced, one or more sections can be removed to expose the base ends of the cyclonettes. Each cyclonette is generally conical and held in place by a retainer nut at its base end. Each nut is threaded into a corresponding bore within the outer cylinder and projects from the outer surface of the outer cylinder. A cyclonette can therefore be removed by simply removing the retaining nut and then withdrawing the entire cyclonette from the concentric cylinders. A new cyclonette is then inserted in the radially aligned bores within the cylinders and secured in place by its retainer nut.

The frustoconical bodies of the cyclonettes occupy a substantial portion of the annular inlet chamber with each vertical row of cyclonettes being offset vertically relative to the adjacent rows. Flow channels are defined in the annular inlet chamber for the free flow of fluid suspension past the cyclonettes in the lower portions of the inlet chamber to those in the upper portions of the inlet chamber or remote from the inlet conduit. More specifically, the flow channels are provided by omitting certain vertical rows of the cyclonettes in the lower portions of the concentric cylinders to define the desired axially or upwardly extending flow channels. For preferred results, the number of omitted cyclonettes may be larger adjacent the bottom inlet end of the inlet chamber than in an intermediate portion of the chamber to provide the resulting flow passage with a downwardly stepped configuration in the direction of flow through the inlet chamber.

Preferably, the concentric inner and outer cylinders are formed by two or more stacked concentric cylindrical sections which are secured together in end to end relation with each concentric section having a predetermined number of vertical rows of cyclonettes. This construction provides for flow channels so that, for example, if the complete assembly comprises three sections, the top section may have the maximum number cyclonettes mounted therein, two vertical rows of cyclonettes may be omitted from the middle section, and the bottom section may have omitted three or four rows of cyclonettes. Thus the resulting flow channels are downwardly stepped in the downstream flow direction.

These and other features and advantages of the invention will be apparent from the detailed description of a preferred embodiment of the invention which follows.

DESCRIPTION OF THE PREFERRED EMBODIMENT

Figure 1:
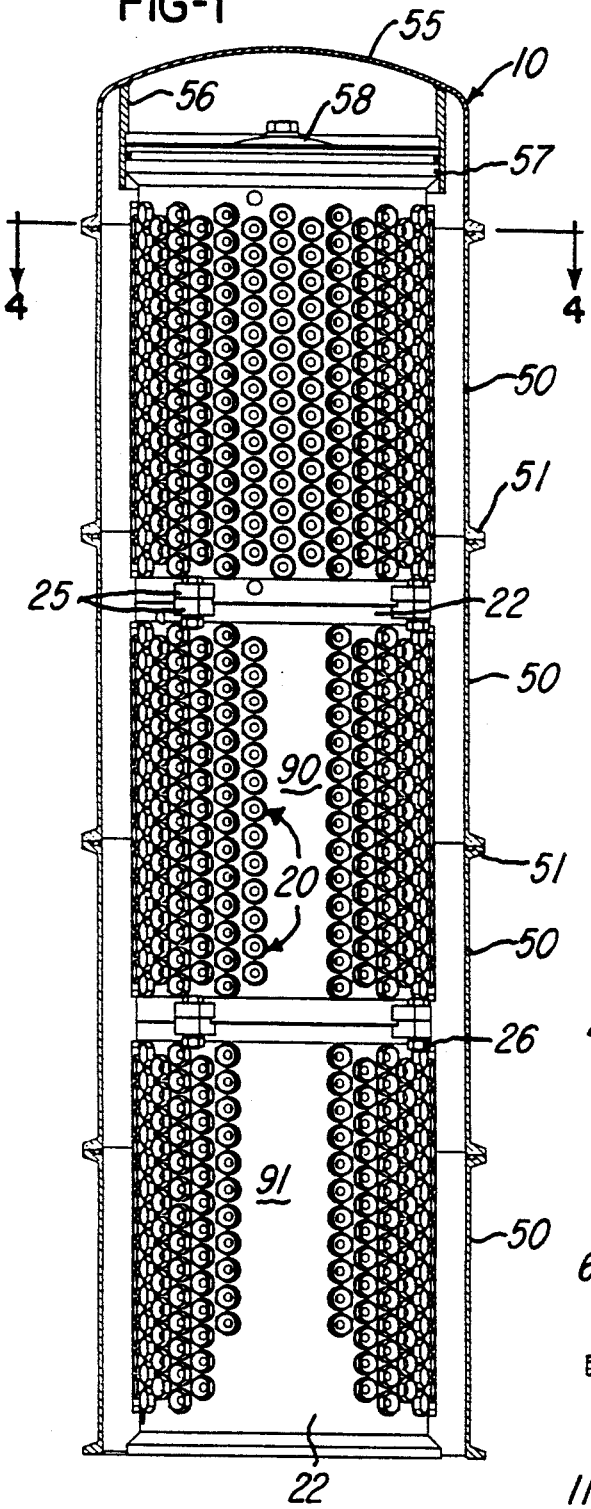
FIG. 1 is a side elevation of a multiple hydrocyclone assembly in accordance with the invention with the outer housing shown in vertical section.

The basic structure of the multiple hydrocyclone assembly constructed in accordance with the invention comprises a closed cylindrical shell or housing 10 having a vertical axis, an inner cylinder 11 and a concentric outer cylinder 12 which cooperate with housing 10 to define a cylindrical inner chamber 13, an annular outer chamber 14, and an annular intermediate chamber 15. In the operation of this assembly to clean a feed suspension in a liquid carrier, the intermediate chamber 15 functions as the inlet chamber for multiple hydrocyclones 20 mounted in the cylinders 11 and 12, and the chambers 14 and 13 function respectively as the outlet chambers for the relatively light and heavy fractions of the feed suspension produced by the cyclonettes 20 mounted in the cylinders 11 and 12.

Figure 3:
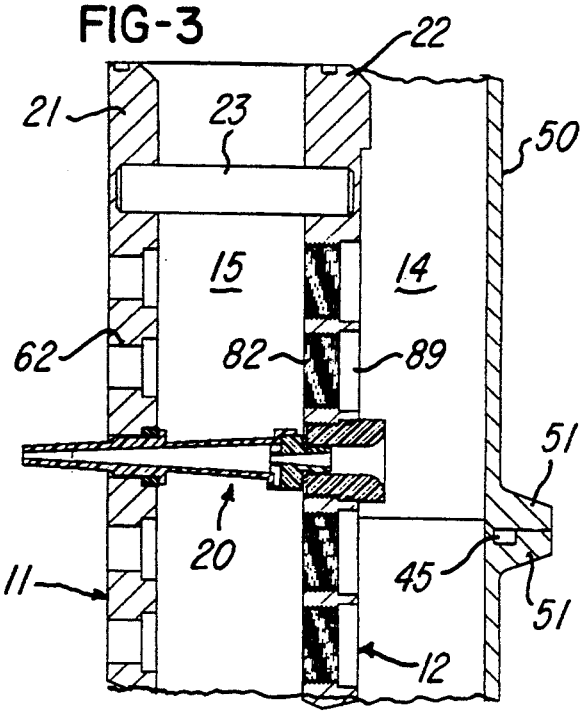
FIG. 3 is an enlarged fragmentary section of the assembly shown in FIG. 1.
Figure 4:
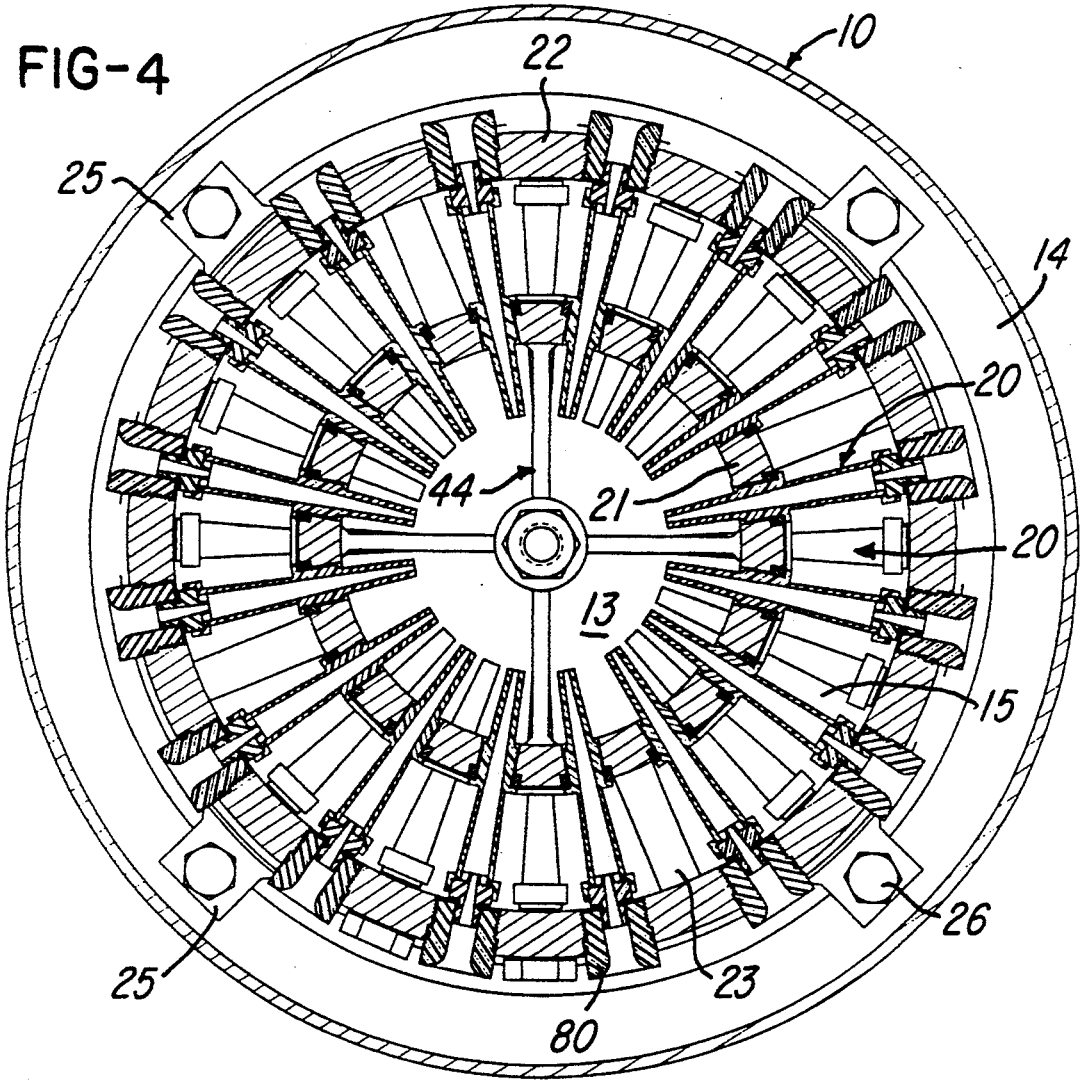
FIG. 4 is an enlarged section taken generally on the line 4—4 in FIG. 1.

The cylinders 11 and 12 are preferably constructed of a plurality of concentric sections which are stacked and secured together in end to end sealed relation. The number of such concentric sections being determined by the desired size and capacity of the complete unit or assembly. As shown in FIG. 3, a set of concentric sections 21 and 22 are secured together by radial tie rods 23 which span the intermediate chamber 15 and are welded to the sections 21 and 22 within aligned bores.

In the embodiment of the invention shown in FIG. 1, there are three sets of concentric sections 21 and 22, and the sets are secured together by lugs 25 projecting from one or both ends of each outer section 22 and fastened together by bolts 26. Thus each set of concentric sections 21 & 22 forms a structural unit which can be used alone or in combination with other sets, as shown in FIG. 1. The assembly of the vertically stacked sections is preferred in that it occupies the minimum amount of floor space.

The lowermost set of concentric sections 21 & 22 is supported by and anchored to a manifold type base assembly 30 comprising an inner pipe 31, an outer pipe 32, an intermediate pipe 33, and a skirt 35 which serves as a support for the entire assembly on a floor or other structure to which the assembly may be bolted or otherwise secured. The concentric pipes 32 and 33 are secured together by circumferentially spaced radial bars 36 which are welded to the pipes 32 and 33. The concentric pipes 31 and 33 are similarly secured together by radial bars 37, and similar bars 38 support a hub 39 within the pipe 31 to form a spider 40 within the inner pipe 31.

Figure 2:
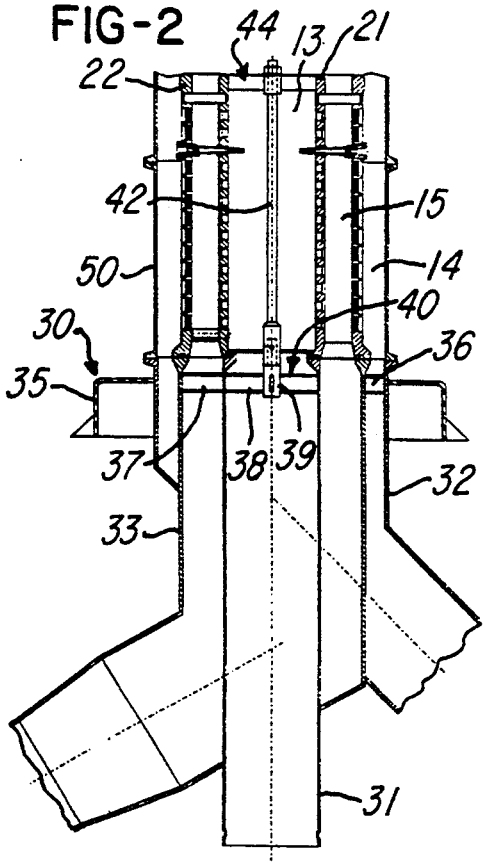
FIG. 2 is a view in vertical section of the base manifold for the assembly shown in FIG. 1.

The intermediate pipe 33 mates with the lower end of the outer cylinder 12 and serves as the inlet conduit for directing the suspension to the inlet chamber 15. The inner and outer pipes 31 and 32 similarly mate with the lower ends of the inner cylinder 11 and housing 10 and serve as outlet conduits for the chambers 13 and 14, respectively. The bottom concentric cylinder sections 21 & 22 are anchored to the base assembly 30 by a center rod 42 (FIG. 2) connected at opposite ends to the spider 40 and a similar spider 44 welded to the upper end of the inner cylinder 11. All connections between the pipes in base assembly 30 and the housing 10 and cylinders 11 and 12 are provided with O-ring seals which are confined in corresponding annular grooves.

The housing 10 is also composed of multiple tubular sections 50, (FIG. 1), and each section 50 includes a peripheral rim or flange 51 at each end thereof. The flanges 51 mate with each other and are secured together in sealed relation by bolts (not shown) and O-ring seals within annular grooves 45.

A dome-shaped cover 55 includes a similar flange 51 and is similarly mounted on the uppermost housing section 50. The cover 55 closes the upper end of the outermost outlet chamber 14 and includes an inner cylindrical wall section 56 which receives an annular support member 57 secured to the upper end of the outer cylinder 12. The member 57 is sealed to the wall 56 so that the inlet chamber 15 extends to the cover 55. A dome-shaped cover 58 closes the inner chamber 13 and is welded to the top end of the inner cylinder 11. An air vent valve (not shown) may be installed in the cover 55 to permit the escape of air from the inlet chamber 15, especially during start-up.

Figure 5:
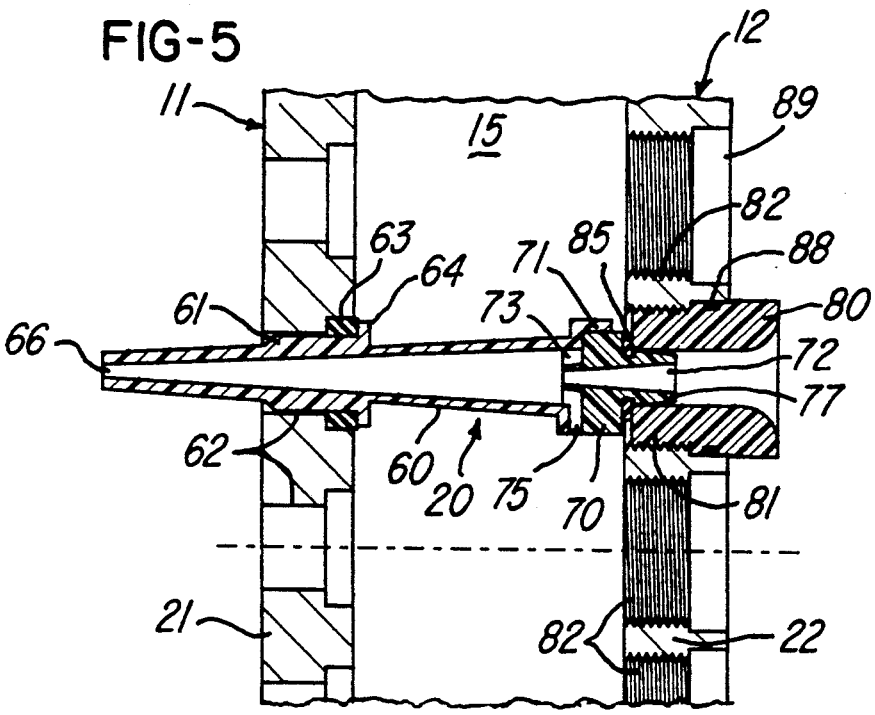
FIG. 5 is a fragmentary section similar to FIG. 3 but on about a full size scale.

The hydrocyclones or cyclonettes 20 are of the reverse flow type. Each includes a frustoconical tubular body 60 (FIG. 5) having a cylindrical boss 61 which fits into a cylindrical bore 62 extending through the inner cylinder section 21. The bore 62 is counterbored on the outside of section 21 to receive a resilient seal 63 which is retained by a flange 64 on the boss 61. An outlet port 66 for heavies is defined at the small apex end of the body 60 inside the inner chamber 13.

A plug 70 is press fitted into a socket 71 on the large or base end of cyclonette body 60 and defines a tapered outlet port 72 for lights and has a tubular vortex finder 73 on its inner end. The socket 71 is slotted to form, with the end of plug 70, a tangentially directed inlet port 75 to the cyclonette body 60. The port 75 receives suspension to be cleaned from the inlet chamber 15.

The plug 70 has a small end portion 77 which projects into a tubular retainer nut 80 having an inner threaded end portion 81 for engaging a tapped bore 82 within the outer cylinder 12. A resilient ring seal 85 is positioned between the inner end of the plug 70 and a shoulder on the plug 70, and a resilient O-ring 88 forms a seal between the retainer nut 80 and an untapped portion 89 of the bore which receives the nut 80.

With this construction and arrangement of each cyclonette 32, when the retainer nut 80 is tightened in the tapped bore portion 82, the nut compresses the seal 85 against the plug 70 and also forces the cyclonette body 60 inwardly to a position where the flange 64 compresses the ring seal 63. The reverse sequence is followed whenever a cyclonette 20 requires replacement. More specifically, the nut 80 is turned counterclockwise and removed, and the cyclonette 20 is removed. A new cyclonette 20 is then inserted into the bore 62, and the retainer nut 80 is tightened in place.

As shown in FIG. 1, the cyclonettes 20 are mounted in the cylinder sections 21 and 22 in vertical rows, with each row being offset vertically or axially with respect to the adjacent rows. The extent of these offsets is selected to position each cyclonette 20 in nested relation with the cyclonettes in the adjacent rows. This arrangement makes it possible to mount the maximum number of individual cyclonettes 20 in each set of concentric cylinder sections 21 and 22. For example, with cylindrical sections 21 and 22 having outer diameters of $7\frac{1}{4}$ inches and $12\frac{3}{8}$ inches, respectively, and an axial length of about 22 inches, and with the chamber 15 having a radial dimension of $1\frac{7}{8}$ inches, it is possible to assemble about 480 cyclonettes each having an overall length of about four inches in a set of concentric cylindrical sections 21 and 22.

There is a particular problem with a compact assembly or cluster of cyclonettes 20 as described above. That is, the cyclonettes 20 produce restrictions to the upward flow of fluid in the inlet chamber 15, and the restrictions produce a significant pressure drop in the fluid. Thus if all of the sets of cylindrical sections 21 & 22 in FIG. 1 had as many cyclonettes therein as the top set, the feed suspension reaching the top set would be substantially lower in pressure than the suspension reaching the lower sets of sections.

The invention solves this problem by establishing flow channels in the portions of the inlet chamber 15 in the lower sets of sections 21 & 22. More specifically, the bottom and intermediate sets of cylindrical sections 21 & 22 have a limited number of hydrocyclones 20 omitted therefrom to provide flow channels through the inlet chamber 15 by which a greater amount of feed suspension can reach the upper set of sections 21 & 22. Preferably this is done by providing axially aligned blank areas in each of the cylinder sections 21 and 22, as shown at 90 and 91 in FIG. 1, so that there will be corresponding open flow passages in the annular inlet chamber 15.

For optimum results, and as illustrated in FIG. 1, the uppermost set of cylinder sections should be Completely equipped with cyclonettes 20, and the number of omitted cyclonettes should increase in the upstream direction, i.e. downwardly in FIG. 1. For example, in a hydrocyclone assembly wherein the cylinders 11 and 12 are of the dimensions mentioned above, and with three sets of cylinder sections, two vertical rows of cyclonettes 20 are omitted from the intermediate set of cylinder sections, and an additional third row is omitted from the bottom set of sections. Also, additional cyclonettes 20 are omitted at the bottom end of the bottom set of sections 21 & 22 to provide a tapered throat leading into the stepped arrangement of flow passages.

This arrangement and the proportioning of the flow passages through each section of the inlet chamber 15 have been found effective to compensate for the volumetric loss of feed suspension in each successive set of cylinder sections 21 & 22, and thereby to maintain substantially constant pressure drop across all of the cyclonettes 20 extending through the annular inlet chamber 15.

In summary, the multiple hydrocyclone assembly of the invention provide desirable advantages. For example, the stainless steel concentric cylinders sections 21 & 22 are secured together to form structural units which have substantial rigidity and structural integrity with minimum thermal expansion. Individual cyclonettes can be easily replaced, if necessary, and the flow channels in the inlet chamber 15 provide for proper pressure distribution throughout the entire assembly of cyclonettes. In addition, the overall construction provides for obtaining the maximum number of cyclonettes for the dimensions of the assembly.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. A multiple hydrocyclone assembly for cleaning a suspension in a liquid carrier, comprising a closed tubular housing having a generally vertical axis, inner and outer generally concentric cylindrical walls within said housing and cooperating with said housing to define an inner outlet chamber, an annular outer outlet chamber and an annular inlet chamber between said outlet chambers, means at the lower end of said housing defining an inlet conduit connected to said inlet chamber and outlet conduits connected to said inner and outer outlet chambers, a multiplicity of conical hydrocyclones extending through generally radially aligned corresponding holes within said concentric walls, each of said hydrocyclones having an apex portion with an apex port and a base portion having means defining a tangentially arranged inlet port and a base outlet port, each of said hydrocyclones being positioned to connect said base port to said outer outlet chamber, said inlet port to said inlet chamber and said apex port to said inner outlet chamber, said holes and said hydrocyclones being arranged in generally vertically extending rows, and said hydrocyclones within at least one of said rows closest to said inlet conduit being omitted and the corresponding said holes being closed to provide a generally vertically extending flow channel in said inlet chamber between adjacent said rows to provide for free flow of said suspension to said hydrocyclones more remote from said inlet conduit and for obtaining a more uniform pressure drop across all of said hydrocyclones.

2. A hydrocyclone assembly as defined in claim 1 wherein said hydrocyclones in each said row are offset vertically with respect to said hydrocyclones in adjacent said rows to position said hydrocyclones in each said row in nested relation with said hydrocyclones in said adjacent rows.

3. A hydrocyclone assembly as defined in claim 1 wherein said rows of hydrocyclones are arranged in stages each consisting of circumferentially spaced said rows, and wherein said rows in said stage most remote from said inlet conduit are continuous around said concentric walls and receive the suspension flowing through said flow channel in the adjacent lower said stage upstream thereof.

4. A hydrocyclone assembly as defined in claim 1 wherein said rows of hydrocyclones are arranged in at least three axially arranged stages each consisting of circumferentially spaced said rows, said rows in said stage most remote from said inlet conduit extending completely around said concentric walls, said stages between said most remote stage and said inlet conduit having progressively fewer said rows of hydrocyclones toward said stage closest to said inlet conduit to provide said flow channel; with a configuration which is progressively narrower in the downstream direction within said inlet chamber.

5. A hydrocyclone assembly as defined in claim 1 wherein the said inner and outer cylindrical walls comprise at least three sets of concentric cylindrical sections, and the intermediate said set of sections having a lesser number of hydrocyclones than said set of sections adjacent the upstream end of said cylinders to provide said flow passage with a configuration which is progressively narrower in the downstream direction within said inlet chamber.

6. A multiple hydrocyclone assembly as defined in claim 1 wherein said housing comprises a set of tubular sections, and means for removably securing said sections together in end to end sealed relation.

7. A multiple hydrocyclone assembly for cleaning a suspension in a liquid carrier, comprising a closed tubular housing having a generally vertical axis, a plurality of vertically stacked sections within said housing, each of said sections including inner and outer generally concentric cylindrical walls cooperating with said housing to define an inner outlet chamber, an annular outer outlet chamber and an annular inlet chamber between said outlet chambers, means at the lower end of said housing defining an inlet conduit connected to said inlet chamber and outlet conduits connected to said inner and outer outlet chambers, a multiplicity of conical hydrocyclones extending through generally radially aligned corresponding holes within said concentric walls of each section, each of said hydrocyclones having an apex portion with an apex outlet port and a base portion having means defining a tangentially arranged inlet port and an outlet port, each of said hydrocyclones being positioned to connect said outlet ports to said outlet chambers and said inlet port to said inlet chamber, said holes and said hydrocyclones being arranged in generally vertically extending and circumferentially spaced rows, said hydrocyclones in each said row being offset vertically with respect to circumferentially adjacent said rows to position said hydrocyclones in each said row in nested relation with said hydrocyclones in said adjacent rows, and said hydrocyclones within at least one of said rows in a lower said section being omitted and the corresponding said holes being closed to provide a generally vertically extending flow channel in said inlet chamber between adjacent said rows to provide for free flow of said suspension to said hydrocyclones within an upper said section and for obtaining a more uniform pressure drop across all of said hydrocyclones.

8. A hydrocyclone assembly as defined in claim 7 wherein said rows in the upper said section are continuous around said concentric walls and receive the suspension flowing through said flow channel within a lower said section.

9. A hydrocyclone assembly as defined in claim 7 and including at least three vertically stacked said sections each consisting of circumferentially spaced said rows, said rows in an upper said section extending completely around said concentric walls, said sections between said upper section and said inlet conduit having progressively fewer said rows of hydrocyclones toward the lowest said section to provide said flow channel with a configuration which is progressively narrower in an upward direction within said inlet chamber.

10. A hydrocyclone assembly as defined in claim 7 and including at least three vertically stacked said sections, and a lower said section having a lesser number of hydrocyclones than an upper said section to provide said flow channel with a configuration which is progressively narrower in an upward direction within said inlet chamber.

11. A multiple hydrocyclone assembly for cleaning a suspension in a liquid carrier, comprising a closed housing, a set of spaced walls spaced within said housing and cooperating with said housing to define a first outlet chamber, a second outlet chamber and an intermediate inlet chamber between said outlet chambers, means at one end of said housing and defining an inlet conduit connected to said intermediate inlet chamber and corresponding outlet conduits extending from said first and second outlet chambers, a multiplicity of conical hydrocyclones supported within corresponding aligned holes within said spaced walls, each of said hydrocyclones having an apex portion including an apex port and a base portion having means defining a tangentially arranged inlet port and a base outlet port, each of said hydrocyclones being positioned to connect said base port to said second outlet chamber, said inlet port to said intermediate inlet chamber and said apex port to said first outlet chamber, said holes and the corresponding said hydrocyclones being arranged in generally parallel rows, and said hydrocyclones within at least one of said rows closest to said inlet conduit being omitted and the corresponding said holes being closed for defining a flow channel in said inlet chamber between adjacent said rows to provide for free flow of said suspension to said hydrocyclones more remote from said inlet conduit and for obtaining a more uniform pressure drop across all of said hydrocyclones.

12. A hydrocyclone assembly as defined in claim 11 wherein said hydrocyclones in each said row are offset in a direction parallel to said rows and with respect to adjacent said rows to position said hydrocyclones in each said row in nested relation with said hydrocyclones in said adjacent rows.

13. A hydrocyclone assembly as defined in claim 11 wherein said rows of hydrocyclones are arranged in at least three stages each consisting of parallel spaced said rows, said rows in said stage most remote from said inlet conduit extending substantially continuous along said walls, said stages between said most remote stage and said inlet conduit having progressively fewer said rows of hydrocyclones toward said stage closest to said inlet conduit to provide said flow channel with a configuration which is progressively narrower in the downstream direction within said inlet chamber.

14. A hydrocyclone assembly as defined in claim 11 wherein the said set of spaced walls comprise at least three sets of wall sections, and an intermediate said set of wall sections supporting a lesser number of hydrocyclones than said set of wall sections adjacent the downstream end of said inlet chamber to provide said flow channel with a configuration which is progressively narrower in the downstream direction within said inlet chamber.

* * * * *